US007483007B2

(12) United States Patent
Chen et al.

(10) Patent No.: US 7,483,007 B2
(45) Date of Patent: Jan. 27, 2009

(54) LIQUID CRYSTAL DISPLAY

(75) Inventors: Fu-Cheng Chen, Tainan County (TW); Chia-Chi Wu, Tainan (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 83 days.

(21) Appl. No.: 11/298,302

(22) Filed: Dec. 9, 2005

(65) Prior Publication Data

US 2006/0132413 A1 Jun. 22, 2006

(30) Foreign Application Priority Data

Dec. 13, 2004 (TW) ..... 93138543 A

(51) Int. Cl.
*G09G 3/36* (2006.01)

(52) U.S. Cl. ..... 345/87; 345/94

(58) Field of Classification Search ..... 345/87–192, 345/204, 208, 211
See application file for complete search history.

(56) References Cited

U.S. PATENT DOCUMENTS

| | | | | |
|---|---|---|---|---|
| 6,005,646 | A | 12/1999 | Nakamura et al. | |
| 6,069,620 | A | 5/2000 | Nakamura et al. | |
| 6,671,009 | B1 * | 12/2003 | Hattori et al. | 349/33 |
| 7,019,728 | B2 * | 3/2006 | Lee et al. | 345/98 |
| 7,202,849 | B2 * | 4/2007 | Hattori et al. | 345/99 |
| 2005/0225545 | A1 | 10/2005 | Takatori et al. | |

* cited by examiner

*Primary Examiner*—Duc Q Dinh
(74) *Attorney, Agent, or Firm*—Fish & Richardson P.C.

(57) ABSTRACT

An alternating electric field is applied across liquid crystal cells of pixels of an optically compensated birefringence mode liquid crystal display during a time period after power is provided to the display to cause the liquid crystal cells to change from a splay state to a bend state. The alternating electric field has a frequency that is less than 40 Hz. After the liquid crystal cells change to the bend state, a backlight module is turned on, and the pixels are controlled to show images with a refresh rate of greater than 40 Hz.

12 Claims, 7 Drawing Sheets

LIQUID CRYSTAL DISPLAY

CROSS-REFERENCE TO RELATED APPLICATIONS

This application claims priority to Taiwan application serial no. 93138543, filed Dec. 13, 2004, titled "METHOD FOR DRIVING LIQUID CRYSTAL DISPLAY," the contents of which are incorporated by reference.

BACKGROUND OF THE INVENTION

This description relates to liquid crystal displays.

There are several types of liquid crystal displays, such as twisted nematic liquid crystal displays, vertically aligned liquid crystal displays, multiple domain vertically aligned liquid crystal displays, and optically compensated birefringence mode (OCB mode, also referred to as optically compensated bend mode, or π cell) liquid crystal displays. OCB mode liquid crystal displays have fast responses and can show movie or animation having fast changing scenes with high clarity. OCB mode liquid crystal displays are described in U.S. Pat. No. 6,069,620, "Driving Method of Liquid Crystal Display Device" and U.S. Pat. No. 6,005,646, "Voltage Application Driving Method," the contents of which are incorporated by reference.

An OCB mode liquid crystal display has an array of pixels that can be independently controlled to show different gray-scales. Referring to FIGS. 1A and 1B, each pixel includes a liquid crystal cell 94 that is positioned between an upper substrate 110 and a lower substrate 120. Attached to the upper substrate 110 are color filters and a common electrode (not shown). Attached to the lower substrate 120 are thin film transistors and pixel electrodes (not shown). The common electrode is driven by a common voltage Vcom, and the pixel electrode is driven by a driving signal Vs. A characteristic of the OCB mode liquid crystal display is that the liquid crystal cell 94 changes between a "splay orientation state" and a "bend orientation state" depending on the voltage applied across the liquid crystal cell 94.

Referring to FIG. 1A, when the voltage difference between the common electrode and the pixel electrode is zero (both Vcom and Vs are equal to zero), the liquid crystal molecules 100 are arranged in the splay state. Referring to FIG. 1B, when the common electrode is maintained at ground voltage (e.g., 0V), and an AC driving signal having an amplitude above a threshold voltage (e.g., 2V) is applied to the pixel electrode, an electric field is created to cause the liquid crystal molecules to be oriented in the bend state. After the liquid crystal cell 94 enters the bend state, adjusting the level of the driving voltage (which is still above the threshold voltage) causes the liquid crystal molecules to change orientation, modifying the amount of light that passes through the liquid crystal cell 94, thereby generating gray-scale. If the driving voltage drops below the threshold voltage, the liquid crystal cell 94 returns to the splay state.

FIG. 2 shows a waveform 200 of a conventional driving signal Vs for driving a pixel electrode of the OCB mode liquid crystal display upon start-up of the display. The common electrode is maintained at ground voltage. Initially, the liquid crystal cell 94 are in the splay state (as shown in FIG. 1A). After the driving signal Vs is applied to the pixel electrode, the liquid crystal cell 94 gradually changes from the splay state to the bend state (as shown in FIG. 1B). The driving signal Vs is a 60 Hz square wave that alternates between 10V and −10V (see portion 202 of the waveform 200). The frequency 60 Hz is used because the refresh rate of the display is 60 Hz. After the liquid crystal cell 94 changes to the bend state, the display can start to show images by driving the pixel electrode according image signals (see portion 204 of waveform 200). In one example, in the bend state, when Vs=2V, the pixel shows full white, when Vs=7V, the pixel shows full black, and when Vs is between 2V to 7V, the pixel shows a gray-scale between full white and full black.

FIG. 2 also shows a waveform 206 of a driving signal $V_L$ for driving a backlight module of the display. Before the liquid crystal cells 94 change to the bend state, the driving signal $V_L$ is low (208) so that the backlight does not turn on. After the liquid crystal cells 94 change to the bend state, the driving signal $V_L$ becomes high (210) so that the backlight is turned on, allowing the user to see images formed by the pixels.

SUMMARY

In another aspect, in general, a method for driving an optically compensated birefringence (OCB) mode liquid crystal display includes applying an alternating electric field across liquid crystal cells of pixels of the display after power is provided to the display to cause the liquid crystal cells to change from a splay orientation state to a bend orientation state, the alternating electric field having a frequency less than 40 Hz, and driving the pixels to show images with a refresh rate of greater than 40 Hz after the liquid crystal cells are in the bend orientation state.

Implementations of the apparatus may include one or more of the following features. Applying the electric field includes coupling a common electrode of the display to a ground voltage or floating the common electrode, the common electrode being common to a plurality of pixels, and applying an alternating voltage signal to pixel electrodes of the display, the alternating voltage signal having a frequency less than 40 Hz. The alternating electric field has a frequency between 1 Hz and 10 Hz. Applying the electric field includes applying a first alternating voltage signal to a common electrode, and applying a second alternating voltage signal to pixel electrodes, wherein the liquid crystal cells are positioned between the common electrode and the pixel electrodes. The first and second voltage signals are selected so that a difference between the voltages at the common electrode and the pixel electrode is higher than a threshold voltage for maintaining the liquid crystal layer at the bend orientation state. The method further includes keeping a backlight module of the display at an off state after power is provided to the display, and turning on the backlight module after the liquid crystal cells change to the bend orientation state.

In another aspect, in general, an OCB mode liquid crystal display includes an array of pixels, each pixel including a common electrode, a pixel electrode, and a liquid crystal cell disposed between the common electrode and the pixel electrode. The liquid crystal display also includes a display controller that controls voltage levels of the common electrode and the pixel electrodes to generate an alternating electric field across the liquid crystal cells after power is provided to the display to cause the liquid crystal layer to change from a splay state to a bend state, the electric field having a frequency f less than 40 Hz. The display controller also controls the array of pixels to show images with a refresh rate greater than 40 Hz after the liquid crystal cells change to the bend state.

Implementations of the apparatus may include one or more of the following features. The voltage signal applied to the common electrode is an AC voltage signal having the frequency f, and the voltage signal applied to the pixel electrode is also an AC signal having the frequency f. The frequency f is between 1 Hz and 10 Hz. The alternating electric field has a square waveform. During a time period that the liquid crystal cells transition from the splay state to the bend state, the absolute value of the electric field is maintained to be continuously larger than a threshold voltage for maintaining the liquid crystal cells at the bend orientation state. Applying the electric field includes applying a first alternating voltage signal to a common electrode and applying a second alternating voltage signal to pixel electrodes, the liquid crystal cells being positioned between the common electrode and the pixel electrodes. During a time period that the liquid crystal cells transition from the splay state to the bend state, a difference between the voltages at the common electrode and the pixel electrode maintained to be continuously higher than a threshold voltage for maintaining the liquid crystal cells at the bend orientation state.

In another aspect, in general, a method for driving an OCB mode liquid crystal display including a display panel having a common electrode, a plurality of pixel electrodes, and an OCB liquid crystal layer positioned between the common electrode and the plurality of pixel electrodes, the driving method including: forming a transition electric field between the common electrode and the plurality of pixel electrodes when the liquid crystal display is turned on, and maintaining the transition electric field continuously for a specific time, wherein the frequency of the transition electric field is smaller than 40 Hz. An image signal is sent to the display panel after the specific time so that an image is displayed by the liquid crystal display in response to the image signal.

Implementations of the apparatus may include one or more of the following features. Forming the transition electric field includes floating the common electrode or electrically coupling the common electrode to a ground terminal, and applying an AC voltage onto the plurality of pixel electrodes respectively, wherein the frequency of the AC voltage is smaller than 40 Hz. Applying the AC voltage onto the plurality of pixel electrodes respectively includes keeping the frequency of the AC voltage between 1 Hz and 10 Hz. Applying the AC voltage onto the plurality of pixel electrodes respectively includes keeping the AC voltage between +10 V and −10 V. The liquid crystal display further includes a backlight module. The method further includes turning on the backlight module after forming the transition electric field. Forming the transition electric field includes applying a common AC voltage to the common electrode and applying a transition AC voltage to the plurality of pixel electrodes respectively. The common AC voltage and the transition AC voltage have inverse polarities. The transition electric field has a frequency between 1 Hz and 10 Hz. The common AC voltage and the transition AC voltage have a voltage difference between 9 to 11 volts.

In another aspect, in general, a method for driving an OCB mode liquid crystal display that includes a display panel having a common electrode, a plurality of pixel electrodes, and an OCB liquid crystal layer positioned between the common electrode and the plurality of pixel electrodes, the driving method including applying a common DC voltage to the common electrode or floating the common electrode, and applying a transition DC voltage to the plurality of pixel electrodes respectively when the liquid crystal display is turned on, so as to form a transition electric field between the common electrode and the plurality of pixel electrodes, and maintaining the transition electric field continuously for a specific time, wherein the common DC voltage and the transition DC voltage have inverse polarities. An image signal is sent to the display panel after the specific time, and an image is displayed on the liquid crystal display in response to the image signal.

Implementations of the apparatus may include one or more of the following features. The voltage difference between the transition DC voltage and the common DC voltage is between 9 to 11 volts. The transition DC voltage is between 5 to 7 volts. The common DC voltage is between −5 to −3 volts. The liquid crystal display further includes a backlight module, and the method further includes turning on the backlight module after the specific time.

DESCRIPTION

By driving liquid crystal cells of an optically compensated birefringence (OCB) mode liquid crystal display using a driving signal Vs having a frequency less than 40 Hz, the time that is needed for the liquid crystal cells to transfer from a splay orientation state to a bend orientation state can be reduced. By changing the common voltage level Vcom and the driving signal Vs simultaneously, the maximum voltage level of the driving signal Vs can be reduced. The shortened driving time period and the reduced driving voltage level result in a reduced power consumption.

Figure 1A:
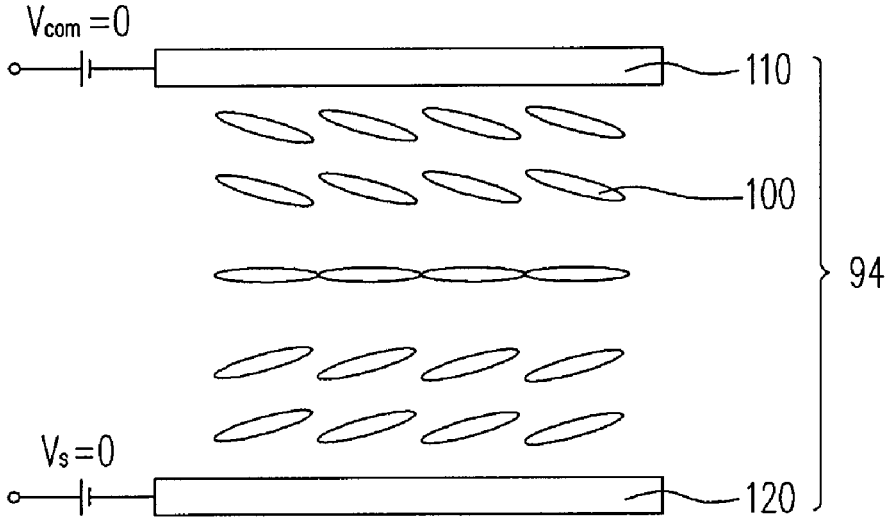
FIG. 1A(PRIOR ART)
FIGS. 1A and 1B depict cross sectional views of a pixel of an optically compensated birefringence mode liquid crystal display.
Figure 1B:
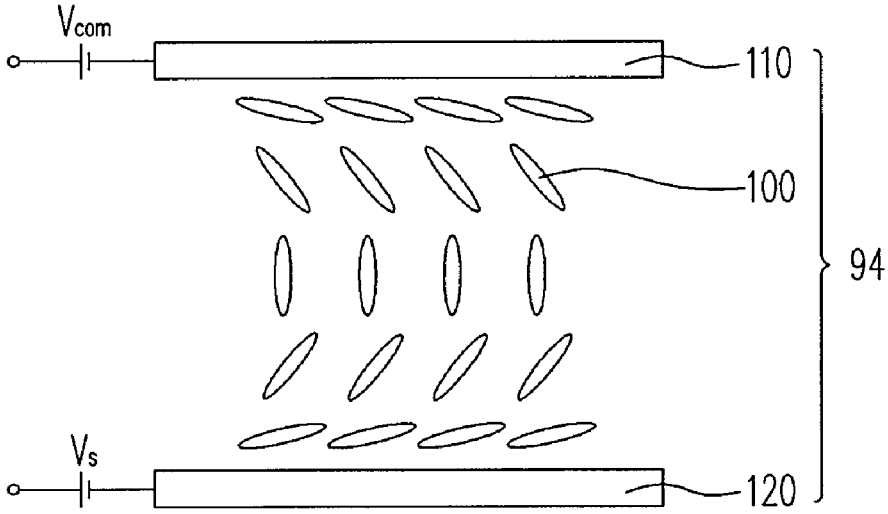
FIG. 1B(PRIOR ART)
Figure 2:
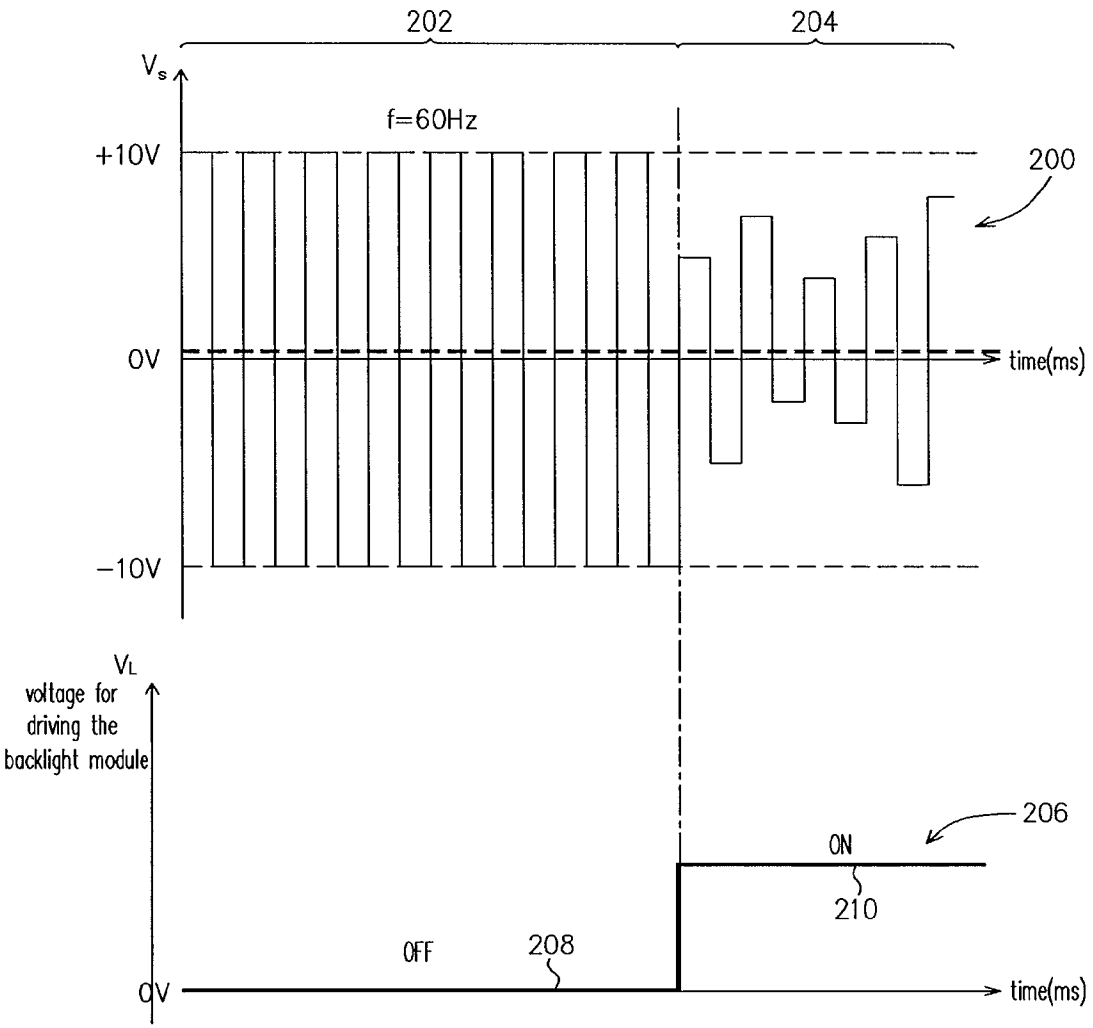
FIG. 2 depicts waveforms of driving signals.
Figure 3:
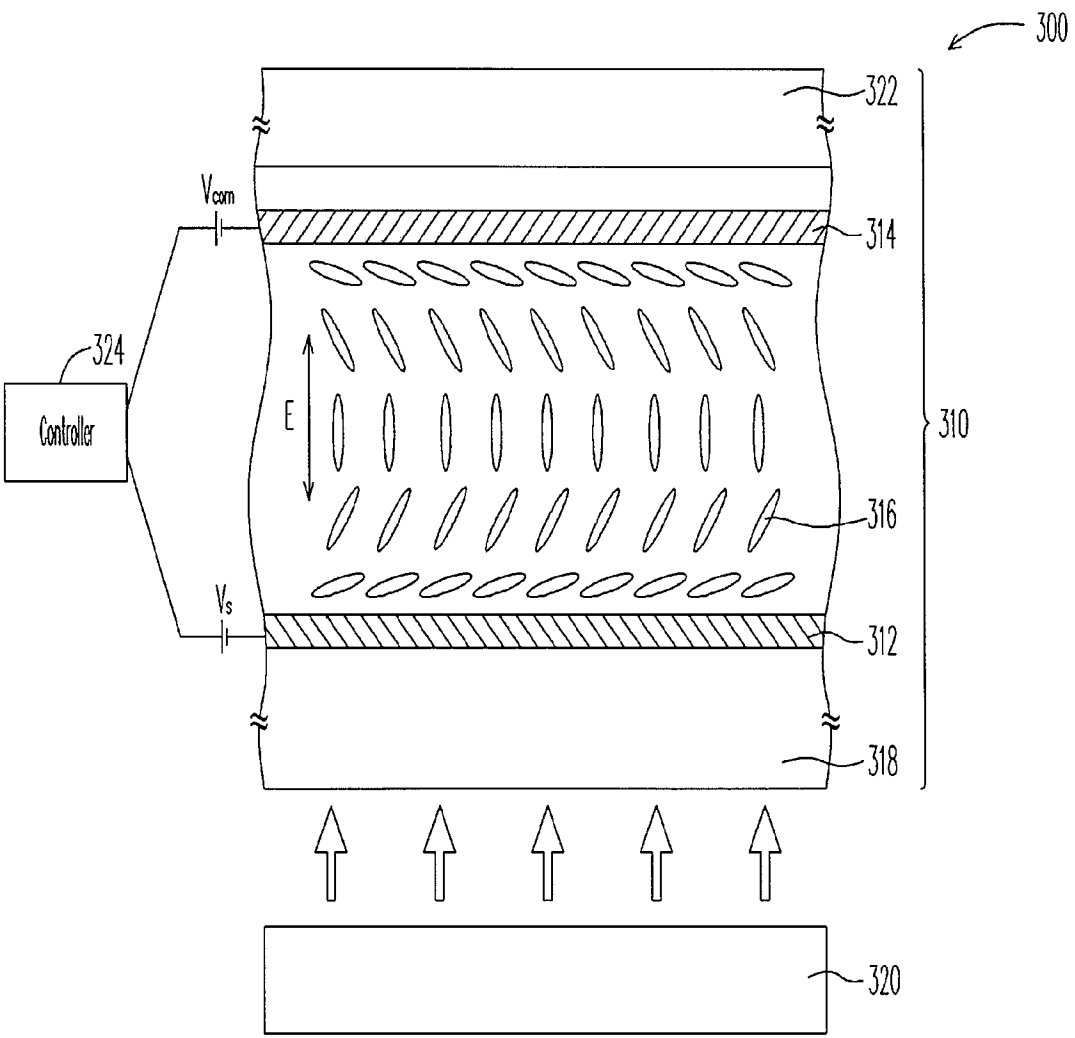
FIG. 3 depicts a cross sectional view of an optically compensated birefringence mode liquid crystal display.

FIG. 3 shows a cross sectional diagram of an example of a portion of an optically compensated birefringence mode liquid crystal display 300. The liquid crystal display 300 includes a display panel 310 and a backlight module 320. The display panel 310 includes a common electrode 314 attached to an upper substrate 322 and pixel electrodes 312 attached to a lower substrate 318. The common electrode 314 is coupled to a common voltage Vcom signal, and the pixel electrode 312 is coupled to a driving signal Vs. A display controller 324 is provided to control the common voltage Vcom signal and the driving signal Vs.

A layer of liquid crystal molecules 316 is provided between the common electrode 314 and the pixel electrode 312. The liquid crystal display 300 has a plurality of pixels, each pixel having a pixel electrode 312. For clarity of illustration, FIG. 3 depicts only one pixel electrode 312. The backlight module 320 generates light that is modulated by the pixels, in which the modulated light forms an image on the liquid crystal display 300.

Figure 4:
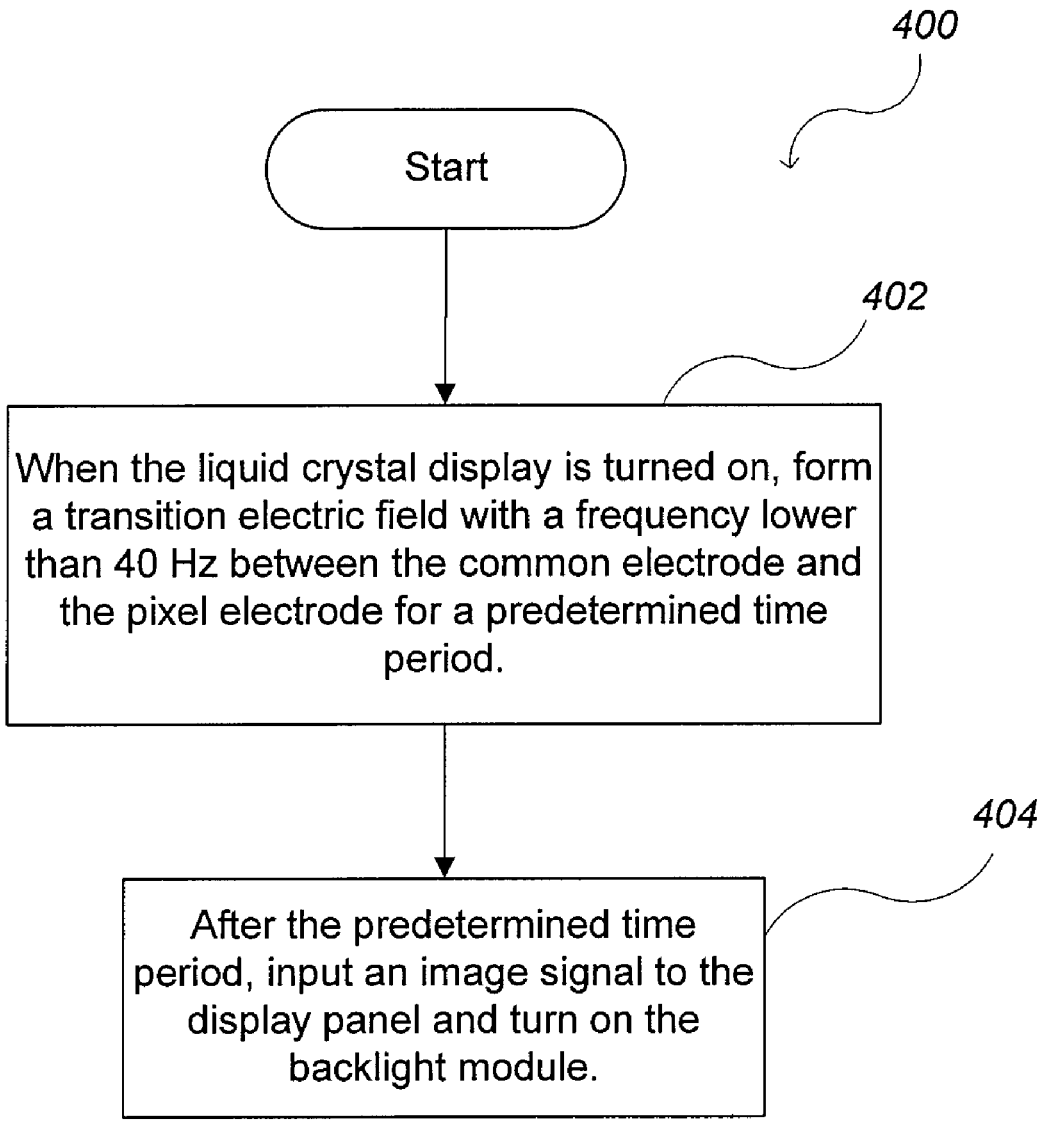
FIG. 4 depicts a flow chart.

FIG. 4 depicts a process 400 for driving the OCB mode liquid crystal display 300 to change the liquid crystal molecules 316 from the splay state to the bend state after the display 300 is powered on. In step 402, a transition electric field E having a frequency less than 40 Hz is formed between the common electrode 314 and the pixel electrode 312 after the liquid crystal display 300 is turned on. The transition electric field E is maintained for a predetermined time duration (for example, between 300 to 600 ms), causing the liquid crystal molecules 316 to change their orientations from the splay state to the bend state (as shown in FIG. 3). Unlike prior art methods that use a driving voltage signal having a frequency that is the same as the refresh rate (60 Hz), the display 300 uses driving signals have frequencies less than 40 Hz, so that the frequency of the transition electric field E is less than 40 Hz.

During the predetermined time period, because the liquid crystal molecules 316 are in transition from the splay state to the bend state, the backlight module 320 is turned off to save power.

In step 404, after the predetermined time period, the backlight module 320 is powered on. The common voltage Vcom is maintained at a predetermined voltage level. The driving signal Vs is driven to levels according to pixel data sent from a host device (for example, a host computer) to cause pixels to display gray-scale levels according to the pixel data.

The amplitude of the transition electric field E is selected to be larger than a threshold value that is sufficient to twist the liquid crystal molecules to change their orientations from the splay state to the bend state. In some examples, the voltage difference between the pixel electrode 312 and the common electrode 314 is about 10 volts. A variety of methods can be used to form the transition electric field E, described below.

Figure 5:
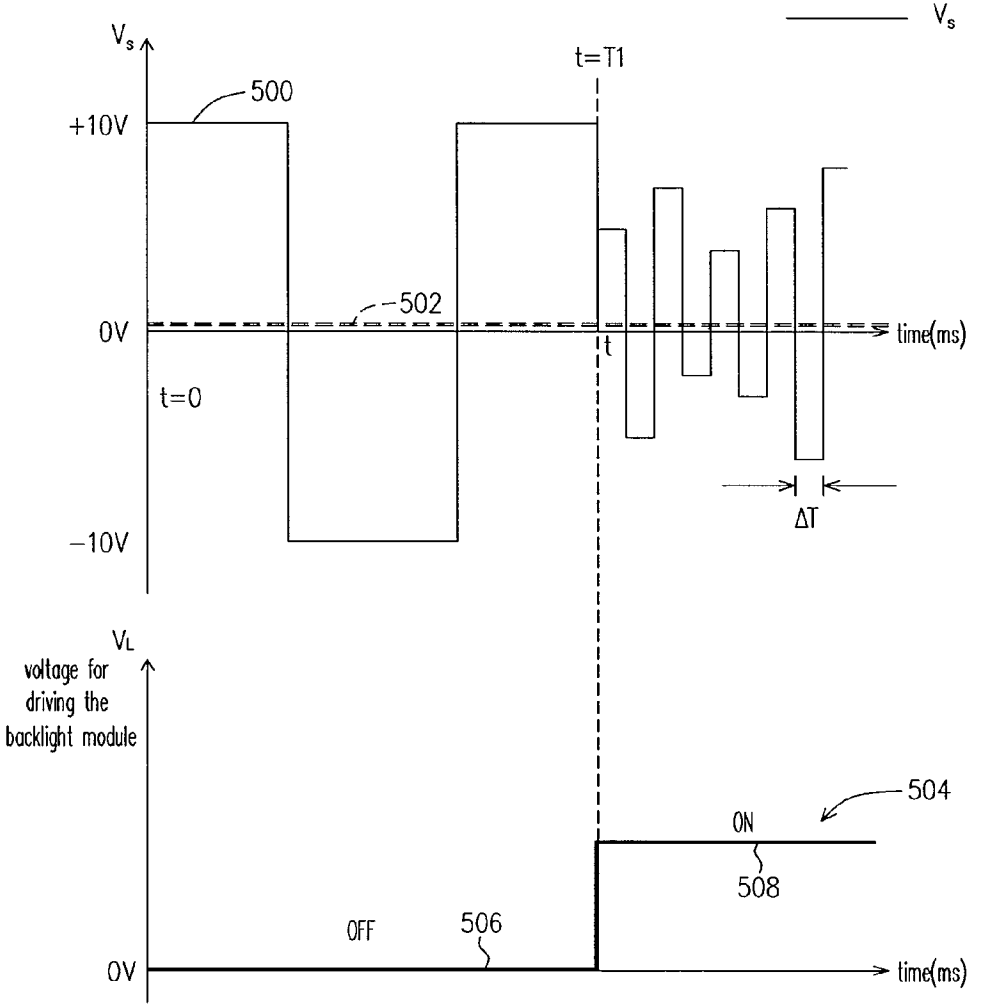
FIGS. 5-7 depict waveforms of driving signals.

FIG. 5 depicts a waveform 500 of the driving signal Vs for driving the pixel electrode 312, a waveform 502 of the common voltage Vcom for driving the common electrode 314, and a waveform 504 of a driving signal $V_L$ for driving the backlight module 320. After the display 300 is powered on, the common voltage Vcom is floated or maintained at a ground voltage level. During a time period between t=0 and t=T1, the driving signal Vs alternates between, for example, +10 and −10 volts, at a frequency that is less than 40 Hz. Depending on the configuration of the display 300, the value T1 can be in a range between 300 ms to 600 ms. For example, the value of T1 may depend on the liquid crystal material and the layout of the electrodes. The value of T1 may also depend on the amplitude of the driving signal Vs. For example, T1 may increase or decrease depending on whether the amplitude of the signal Vs decreases or increases, respectively. In some examples, the driving signal Vs has a frequency between 1 Hz and 10 Hz.

The voltage difference between the common electrode 314 and the pixel electrode 312 generates a transition electric field E that causes the liquid crystal molecules 316 to change orientations and transfer from the splay state to the bend state. During the time period t=0 to t=T1, the backlight driving signal $V_L$ is low (506) so that the backlight module 320 is not turned on. This reduces power consumption.

After t=T1, the backlight driving signal $V_L$ turns high (508) to turn on the backlight module 320. Also, the driving signal Vs has a voltage level determined based on pixel data sent from a host device (for example, a host computer). The voltage level of Vs applied to each pixel determines the tilt of the liquid crystal molecules and the amount of light that passes through the liquid crystal layer at the pixel.

Before t=T1, the driving signal Vs alternates at a frequency less than 40 Hz. After t=T1, the driving signal Vs changes at a rate based on the display refresh rate. In FIG. 5, the duration ΔT of each cycle is equal to the frame period, so that a pixel maintains the same gray-scale during the frame period.

Figure 6:
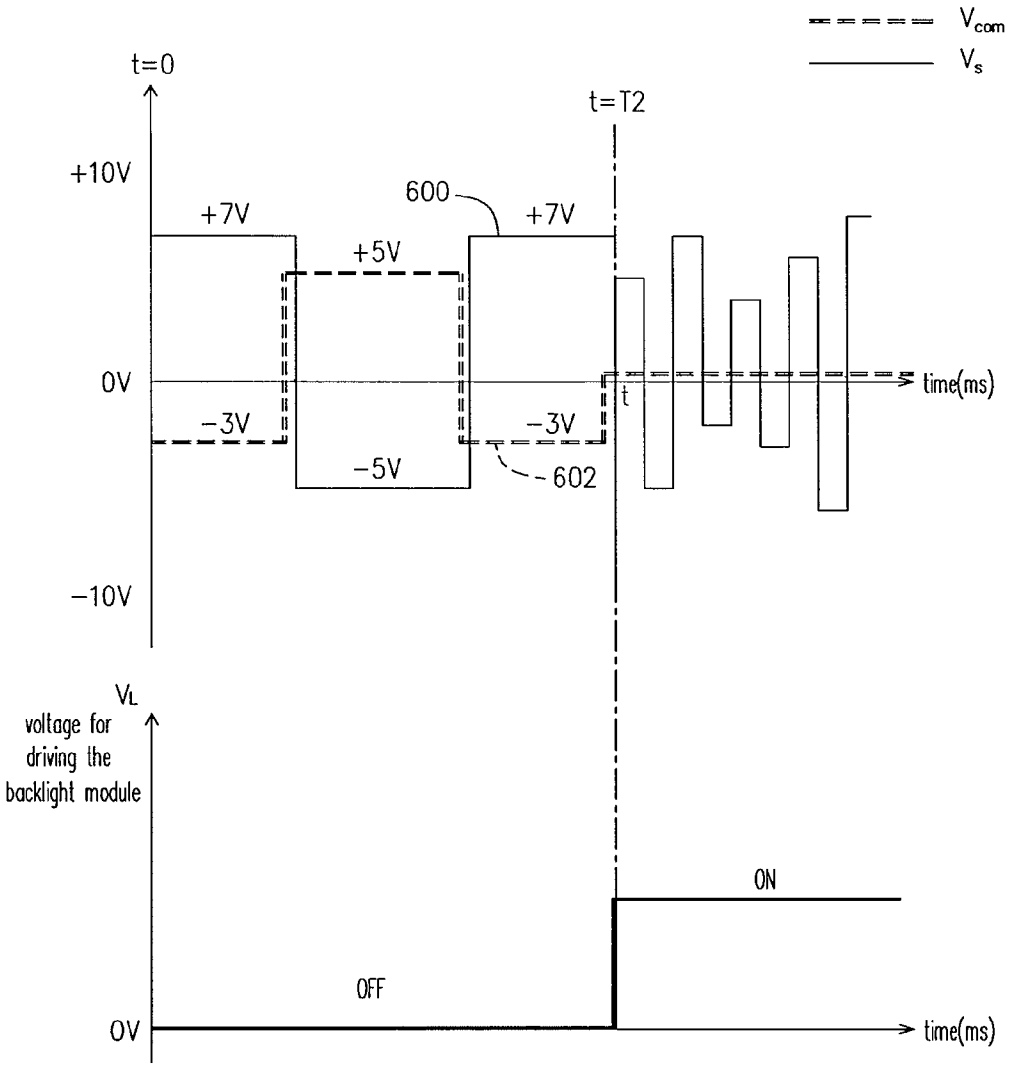

FIG. 6 depicts another example of waveforms of signals Vcom, Vs, and $V_L$ for driving the common electrode 314, the pixel electrode 312, and the backlight module 320, respectively. In this example, the signals Vs (600) and Vcom (602) alternate at the same frequency during a time period t=0 to t=T2 after the liquid crystal display 300 is turned on. For example, the signal Vs may alternate between 7V and −5V, whereas the signal Vcom may alternate between −3V and 5V. The difference between Vs and Vcom is maintained at 10V, which is larger than the threshold voltage needed to change the liquid crystal molecules from the splay state to the bend state. The maximum amplitude of the signal Vs is reduced to 7V (as compared to 10V in FIG. 5), so that power consumption is reduced.

The voltage difference between Vcom and Vs forms a transition electric field E having a frequency less than 40 Hz between the pixel electrode 312 and the common electrode 314. The transition electric field E causes the liquid crystal molecules 316 to change orientations and transfer from the splay state to the bend state. During the time period t=0 to t=T2, the backlight driving signal $V_L$ is low so that the backlight module 320 is not turned on. This reduces power consumption.

Similar to the situation in FIG. 5, in the example of FIG. 6, after t=T2, the backlight driving signal $V_L$ turns high to turn on the backlight module 320. Also, the driving signal Vs has a voltage level determined based on pixel data sent from a host device (for example, a host computer). The voltage level of Vs applied to each pixel determines the tilt of the liquid crystal molecules and the amount of light that passes through the liquid crystal layer at the pixel.

The voltage levels of Vs and Vcom can be different than those shown in FIG. 6. For example, the signal Vs can alternate between 6V and −6V, and the signal Vcom can alternate between −4V and 4V, so that the difference between Vs and Vcom is maintained at 10V, while the maximum amplitude of the signal Vs is only 6V.

The difference between Vs and Vcom can have values other than 10V, as long as the difference is larger than the threshold voltage for changing the liquid crystal cells from the splay state to the bend state. For example, the signal Vs can alternate between 4V and −4V, and the signal Vcom can alternate between −4V and 4V so that |Vs−Vcom|=8V.

Figure 7:
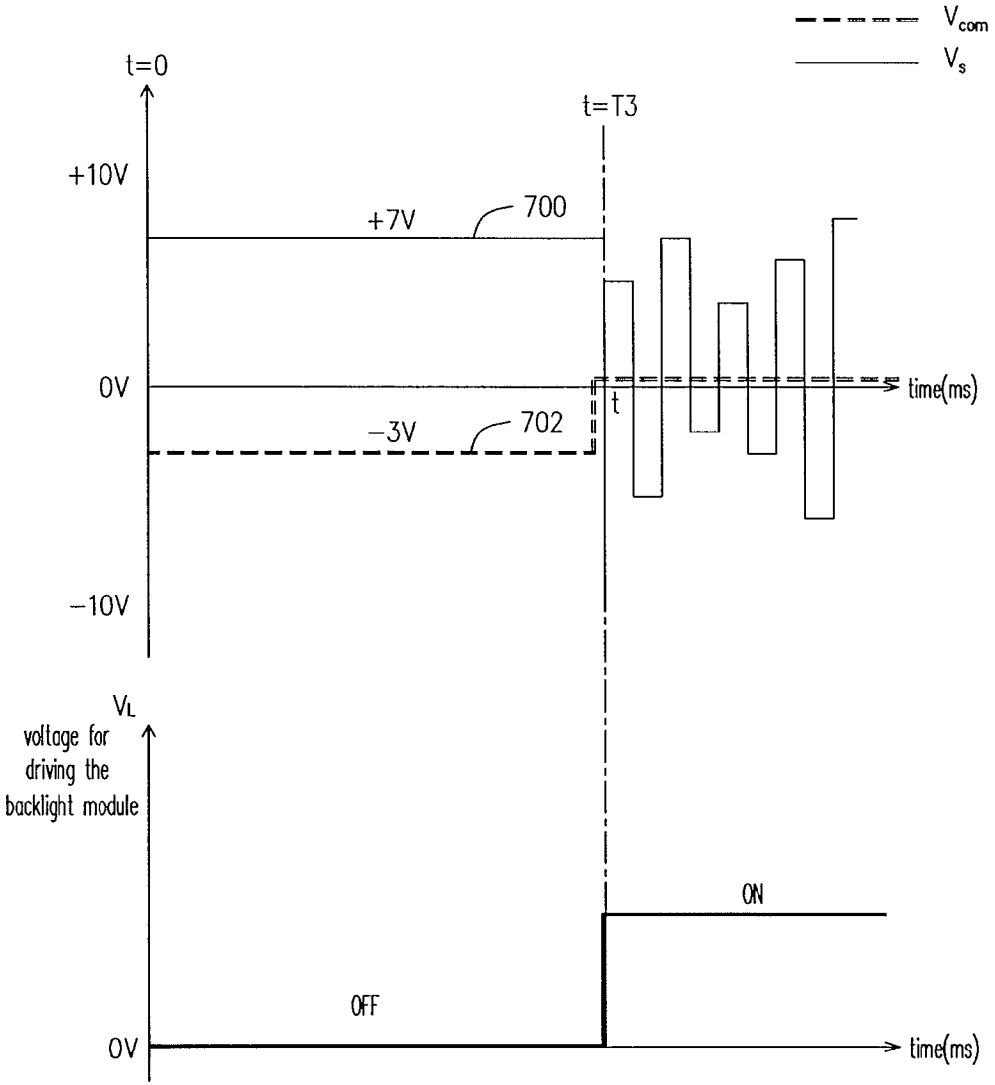

FIG. 7 depicts another example of waveforms of signals Vcom, Vs, and VL for driving the common electrode 314, the pixel electrode 312, and the backlight module 320, respectively. In this example, the signals Vs (700) and Vcom (702) are constant voltages during a time period t=0 to t=T3 after the liquid crystal display 300 is turned on. For example, the Vs=7V and Vcom=−3V. The difference between Vs and Vcom is 10V, which is larger than the threshold voltage needed to change the liquid crystal molecules from the splay state to the bend state. The maximum amplitude of the signal Vs is reduced to 7V (as compared to 10V in FIG. 5), which reduces power consumption.

The signal Vs and Vcom applied to the pixel electrode and common electrode, respectively, generate a constant transition electric field E so that the liquid crystal molecules 316 are twisted continuously towards the same direction during t=0 to t=T3, causing the liquid crystal molecules to change from the splay state to the bend state.

The values of Vs and Vcom can be different from those shown in the example of FIG. 7. For example, (Vs, Vcom) can be (6V, −4V) or (−5V, 5V).

Similar to the situation in FIG. 5, in the example of FIG. 7, after t=T3, the backlight driving signal $V_L$ turns high to turn on the backlight module 320. Also, the driving signal Vs has a voltage level determined based on pixel data sent from a host device (for example, a host computer). The voltage level of Vs applied to each pixel determines the tilt of the liquid crystal molecules and the amount of light that passes through the liquid crystal layer at the pixel.

The waveforms in FIG. 7 also represent the situation in which the Vs and Vcom signals are AC signals having periods that are greater than twice the duration t=0 to t=T3.

An advantage of using the driving signals described above, such as those shown in FIGS. 5-7, is that the amount of time required to change from the splay state to the bend state after power-on of the display is reduced. Some portable devices have displays that enter a "sleep mode" in which electric power sent to the display is reduced or shut off, the data drivers stop driving the pixels, and the liquid crystal cells return to the splay state. For such devices, using the driving methods described above can allow the display to quickly enter the bend state and resume displaying images when the device "wakes up." Because the display can start to show images within a shorter amount of time after power-on or after being awakened from sleep mode, less power is wasted in "warming up" the display to cause the liquid crystal cells to enter the bend state. This increases battery life of the portable devices.

Using the driving methods shown in FIGS. 6 and 7, a lower voltage can be used to drive the liquid crystal cells from the splay state to the bend state, so that power consumption is reduced. This is useful for mobile devices having displays that are turned on and off frequently.

Although some examples have been discussed above, other implementations and applications are also within the scope of the following claims.

What is claimed is:

1. A method for driving a liquid crystal display that includes a display panel having a common electrode, a plurality of pixel electrodes and an optically compensated birefringence (OCB) liquid crystal layer, the OCB liquid crystal layer positioned between the common electrode and the plurality of pixel electrodes, the driving method comprising:

after a liquid crystal display is powered on, turning off a backlight module for a specific period of time;

forming a constant DC transition electric field between the common electrode and the plurality of pixel electrodes, and maintaining the constant DC transition electric field continuously for the entire period of time that the backlight module is turned off to cause the liquid crystal to change from a splay state to a bend state, in which forming a constant DC transition electric field comprises applying a common constant DC voltage to the common electrode, and applying a transition constant DC voltage to the plurality of pixel electrodes respectively, the common constant DC voltage being the inverse voltage of the transition constant DC voltage;

turning on the backlight module after the specific period of time; and sending an image signal to the display panel after the specific time, and displaying an image on the liquid crystal display in response to the image signal.

2. The method of claim 1, wherein applying the transition constant DC voltage to the plurality of pixel electrodes comprises applying a constant DC voltage having a voltage level of about 7V, 6V, or −5V.

3. The method of claim 1, further comprising maintaining the common constant DC voltage and the transition constant DC voltage so that a difference of the common constant DC voltage and the transition constant DC voltage has an absolute value of about 10 volts.

4. A method for driving a liquid crystal display that includes a display panel having a common electrode, a plurality of pixel electrodes and an optically compensated birefringence (OCB) liquid crystal layer, the OCB liquid crystal layer positioned between the common electrode and the plurality of pixel electrodes, the driving method comprising:

turning off a backlight module during a specific period of time;

applying a common constant DC voltage to the common electrode, and applying a transition constant DC voltage to the plurality of pixel electrodes respectively when the liquid crystal display is turned on, to form a constant DC transition electric field between the common electrode and the plurality of pixel electrodes for the entire period of time that the backlight module is turned off, and maintaining the transition electric field continuously for the specific period of time, wherein the common constant DC voltage and the transition constant DC voltage have different polarities;

turning on the backlight module after the specific period of time; and sending an image signal to the display panel after the specific time, and displaying an image on the liquid crystal display in response to the image signal.

5. The method of claim 4, further comprising maintaining a difference between the transition constant DC voltage and the common constant DC voltage in a range of 9 to 11 volts.

6. The method of claim 4, further comprising maintaining the transition constant DC voltage between 5 to 7 volts.

7. The method of claim 6, further comprising maintaining the common constant DC voltage between −5 to −3 volts.

8. A method, comprising:

turning off a backlight module during a period of time;

applying a constant electric field across liquid crystal cells of pixels of an optically compensated birefringence mode liquid crystal display for the entire period of time that the backlight module is turned off to cause the liquid crystal cells to change from a splay orientation state to a bend orientation state, in which applying the constant electric field comprises applying a first constant DC voltage signal to a common electrode and applying a second constant DC voltage signal to pixel electrodes, the liquid crystal cells being positioned between the common electrode and the pixel electrodes, the first constant DC voltage signal being the inverse voltage of the second constant DC voltage signal;

turning on the backlight module after the period of time; and driving the pixels to show images after the liquid crystal cells are in the bend orientation state.

9. The method of claim 8, in which, during a time period that the liquid crystal cells transition from the splay state to the bend state, the absolute value of the electric field is maintained to be continuously larger than a threshold voltage for maintaining the liquid crystal cells at the bend orientation state.

10. The method of claim 8 in which, during a time period that the liquid crystal cells transition from the splay state to the bend state, a difference between the voltages at the common electrode and the pixel electrode maintained to be continuously higher than a threshold voltage for maintaining the liquid crystal cells at the bend orientation state.

11. An optically compensated birefringence (OCB) mode liquid crystal display, comprising:

an array of pixels, each pixel comprising a common electrode, a pixel electrode, and a liquid crystal cell disposed between the common electrode and the pixel electrode; and a display controller to cause a first constant DC voltage to be applied to the common electrode and a second constant DC voltage to be applied to the pixel electrode to generate a constant electric field across the liquid crystal cells after power is provided to the display to cause the liquid crystal cells to change from a splay state to a bend state, the common constant DC voltage being the inverse voltage of the transition constant DC voltage, the display controller causing a backlight module to be turned off during a period of time, the display controller causing the constant electric field to be maintained during an entire period of time when the backlight module is turned off, the display controller also controlling the array of pixels to show images and turning on the backlight module after the liquid crystal cells change to the bend state.

12. The OCB mode liquid crystal display of claim 11 in which, during a time period that the liquid crystal cells transition from the splay state to the bend state, a difference between the voltage levels of the common electrode and the pixel electrode is continuously greater than a threshold voltage for maintaining the liquid crystal cells at the bend state.

* * * * *

UNITED STATES PATENT AND TRADEMARK OFFICE

CERTIFICATE OF CORRECTION

PATENT NO. : 7,483,007 B2
APPLICATION NO. : 11/298302
DATED : January 27, 2009
INVENTOR(S) : Fu-Cheng Chen It is certified that error appears in the above-identified patent and that said Letters Patent is hereby corrected as shown below:

In Claim 1, Col. 7, Line 35, after “crystal” insert --layer--.

In Claim 1, Col. 7, Line 37, after “forming” delete “a” and insert --the--.

In Claim 1, Col. 7, Line 46, after “specific” insert --period of--.

Signed and Sealed this

Fifth Day of May, 2009

JOHN DOLL
*Acting Director of the United States Patent and Trademark Office*